US007493777B2

(12) United States Patent
Kim et al.

(10) Patent No.: US 7,493,777 B2
(45) **Date of Patent: *Feb. 24, 2009**

(54) COLD AIR GUIDE STRUCTURE OF ICE-MAKING CHAMBER OF COLD CHAMBER DOOR

(75) Inventors: Seong Jae Kim, Ansan-si (KR); Chang Ho Seo, Seoul (KR); Myung Ryul Lee, Seongnam-si (KR); Sung Hoon Chung, Seoul (KR)

(73) Assignee: LG Electronics, Inc., Seoul (KR)

( * ) Notice: Subject to any disclaimer, the term of this patent is extended or adjusted under 35 U.S.C. 154(b) by 96 days.

This patent is subject to a terminal disclaimer.

(21) Appl. No.: 11/750,210

(22) Filed: May 17, 2007

(65) Prior Publication Data

US 2007/0209382 A1 Sep. 13, 2007

Related U.S. Application Data

(63) Continuation of application No. 11/071,149, filed on Mar. 4, 2005, now Pat. No. 7,228,703.

(30) Foreign Application Priority Data

Mar. 24, 2004 (KR) ..... 19963/2004
Apr. 6, 2004 (KR) ..... 23461/2004

(51) Int. Cl.
*F25C 1/00* (2006.01)

(52) U.S. Cl. ..... 62/353; 62/426

(58) Field of Classification Search ..... 62/340–356, 62/404–426

See application file for complete search history.

(56) References Cited

U.S. PATENT DOCUMENTS

| | | | |
|---|---|---|---|
| 2,199,413 | A | 5/1940 | Patrignani |
| 2,900,803 | A | 8/1959 | Horton, Jr. |
| 3,025,679 | A | 3/1962 | Keighley |
| 3,025,683 | A | 3/1962 | Baker et al. |
| 3,146,601 | A | 9/1964 | Gould |
| 3,545,217 | A | 12/1970 | Linstromberg |
| 3,789,620 | A | 2/1974 | Benasutti et al. |
| 3,933,198 | A | 1/1976 | Hara et al. |
| 4,368,622 | A | 1/1983 | Brooks |
| 4,970,871 | A | 11/1990 | Rudick |

(Continued)

*Primary Examiner*—William E Tapolcai
(74) *Attorney, Agent, or Firm*—Birch, Stewart, Kolasch & Birch, LLP

(57) ABSTRACT

A refrigerator includes a cold chamber; a cold chamber door for covering the cold chamber; a freezing chamber; a thermal insulation case on the cold chamber door; an ice-making chamber located on an inner side of the cold chamber door and covered by the thermal insulation case; an ice-making unit installed in the ice-making chamber for making ice using ice-making cold air supplied from the freezing chamber; and a cold air guide structure including: a cold air inlet port for supplying the ice-making cold air into the ice-making chamber; a cold air outlet port for exhausting the ice-making cold air from the ice-making chamber; a cold air supply passage along a wall of the refrigerator to supply the ice-making cold air from the freezing chamber to the cold air inlet port; and a cold air return passage along the wall of the refrigerator to discharge the exhausted ice-making cold air from the cold air outlet port to the freezing chamber.

20 Claims, 15 Drawing Sheets

U.S. PATENT DOCUMENTS

| | | | |
|---|---|---|---|
| 5,211,462 | A | 5/1993 | Bien et al. |
| 5,272,888 | A | 12/1993 | Fisher et al. |
| 5,896,752 | A | 4/1999 | Park et al. |
| 6,050,097 | A | 4/2000 | Nelson et al. |
| 6,082,130 | A | 7/2000 | Pastryk et al. |
| 6,085,542 | A | 7/2000 | Johnson et al. |
| 6,148,624 | A | 11/2000 | Bishop et al. |
| 6,351,955 | B1 | 3/2002 | Oltman et al. |
| 6,732,537 | B1 | 5/2004 | Anell et al. |
| 6,735,959 | B1 | 5/2004 | Najewicz |
| 6,945,068 | B2 | 9/2005 | Kim et al. |
| 6,964,177 | B2 | 11/2005 | Lee et al. |
| 7,076,967 | B2 | 7/2006 | Lee et al. |
| 7,188,479 | B2 | 3/2007 | Anselmino et al. |

COLD AIR GUIDE STRUCTURE OF ICE-MAKING CHAMBER OF COLD CHAMBER DOOR

This application is a Continuation of application Ser. No. 11/071,149 filed on Mar. 4, 2005, now U.S. Pat. No. 7,228,703 now allowed, and for which priority is claimed under 35 U.S.C. Section 120; and this application claims priority of Korean Application Nos. 19963/2004 and 23461/2004 filed on Mar. 24, 2004 and Apr. 6, 2004 respectively under 35 U.S.C. Section 119; the entire contents of all are hereby incorporated by reference.

BACKGROUND OF THE INVENTION

1. Field of the Invention

The present invention relates to a refrigerator, and more particularly, to a cold air guide structure of an ice-making chamber of a cold chamber door in which an ice-making unit is installed in an insulation space (Hereinafter, referred to as "ice-making chamber") provided inside of the cold chamber door, and cold air can be guided to the maximum into the ice-making chamber.

2. Description of the Related Art

Generally, in a refrigerator, cold air is generated by a refrigeration cycle, which is performed by a compressor, a condenser, an expansive valve and an evaporator, to reduce an internal temperature, thereby freezing a food or keeping the food cool.

The refrigerator is classified into a top mount-type refrigerator having a freezing chamber and a cold chamber partitioned up and down, a bottom freezer-type refrigerator having a cold chamber and a freezing chamber partitioned up and down, and a side by side-type refrigerator having a freezing chamber and a cold chamber partitioned left and right.

As shown in FIG. 1, the bottom freezer-type refrigerator has a cold chamber 2 and a freezing chamber 5 partitioned up and down by a barrier 11 of a refrigerator body 1; a cold chamber door 3 for opening and closing the cold chamber 2; and a freezing chamber door 4 for opening and closing the freezing chamber.

The bottom freezer-type refrigerator having a conventional ice-making unit is shown in FIG. 2. Referring to FIG. 2, the refrigerator includes a compressor 6 installed in a machine chamber, which is disposed at a rear of a refrigerator body 1, to compress a refrigerant; an evaporator 7 and a ventilation fan 8 connected with the compressor 6 through a refrigerant pipe to be installed at a rear wall of the freezing chamber to supply cold air; ducts 9 and 10 for returning the cold air; and an ice-making unit 12 installed inside of the freezing chamber door 4 to ice a supplied water, and take out and keep pieces of ice.

The ice-making unit is mainly comprised of an ice maker 20 for icing the supplied water and taking out the pieces of ice; and an ice bank 30 for keeping the pieces of ice taken out by the ice maker 20.

The above-described ice-making unit of the bottom freezer-type refrigerator is described with reference to FIG. 2 as follows.

First, the refrigerant changed into a low-temperature and low-pressure vaporized state by the evaporator 7 is flowed to the compressor 6 and is compressed at a high temperature and a high pressure by the compressor 6, and the compressed refrigerant is cooled and condensed while being passing through the condenser to be changed into a high-pressure liquid state.

The refrigerant changed into the high-pressure liquid state passes through the expansive valve (not shown) while being reduced in pressure to be in a state of facilitating the evaporation of the refrigerant in the evaporator 7 through heat-exchange. After that, the refrigerant is again flowed to the evaporator 7 performing an evaporation process of the refrigerant.

The refrigerant flowed to the evaporator 7 is changed into the low-temperature and low-pressure vaporized state through an endothermic reaction for the absorption of an internal heat from the refrigerator while cooling ambient air, and then is flowed to the compressor 6, thereby performing the refrigeration cycle.

At this time, the air (cold air) emitting a heat while being cooled using the refrigerant through the heat exchange with the evaporator 7 is discharged from a freezing chamber 5 side by driving the ventilation fan 8 installed at an upper side of the evaporator 7. At this time, the refrigerant discharged by the driving of the ventilation fan 8 is respectively branched to the freezing chamber 5 and the cold chamber 2 depending on a damper operation.

Meanwhile, the cold air is supplied to the cold chamber by the cold air discharge port 2*b* through the cold air supply duct 2*a* installed at a rear wall of the freezing chamber.

After that, the cold air used in the cold chamber 2 and the freezing chamber 5 is again returned to a lower side of the evaporator through the return ducts 9 and 10.

Here, the cold air discharged to the freezing chamber 5 side is introduced to the ice maker 20 of the ice-making unit 12 installed at the freezing chamber 5, to allow the ice-making unit 12 to perform ice manufacture.

The ice-making unit 121 is in detail described with reference to FIG. 3 in the following. The ice maker 20 includes a mold 21 for making the pieces of ice; and a water supplying unit 22 disposed at one side of the mold 21 to supply water to the mold 21.

The mold 21 is approximately semi-cylindrical shaped, and has a partition rib 21*a* upwardly protruded at each of predetermined intervals to separate the pieces of ice. Further, a coupling unit 25 is provided at a rear portion of the mold 21 to fix the ice-making unit 12 in the freezing chamber.

A motor unit 23 is installed at one side of the mold 21. A motor is built in the motor unit 23, and an ejector 24 is rotatably connected to a rotary shaft of the motor.

The ejector 24 is installed to allow the rotary shaft to intersect with a center of the mold 21, and a plurality of ejector pins 24*a* are installed to be approximately vertical to the ejector 24 and be spaced apart at each of predetermined intervals. At this time, the ejector pins 24*a* are respectively disposed at each of intervals partitioned by the partition rib 21*a*.

A plurality of slide bars 26 are extended up to a vicinity of the rotary shaft of the ejector 24 at a rear and upper side of the mold 21.

Further, a heater (not shown) is installed at a bottom surface of the mold 21. The heater heats the surface of the mold for a short time to melt an ice surface adhered to the surface of the mold such that the pieces of ice can be easily separated from the mold 21.

If the ice manufacture is completed in the ice maker 20 through the ice-making reaction, deicing is initiated. That is, in the deicing operation, the ice maker 20 is heated at its lower portion by the heater installed at the bottom surface of the ice maker 20 to be in a state where the pieces of ice can be easily separated. After that, the pieces of ice are separated by the rotation of the ejector 24 rotatably installed at the ice maker 20 to be kept in the ice bank 30 installed at a lower side of the ice maker 20.

Furthermore, an ice-overflow sensing arm 28 is installed at the ice maker 20 to sense an amount of the pieces of ice filled in the ice bank 30. The ice-overflow sensing arm 28 is installed to move up and down, and is also connected to a controller (not shown) built in the motor unit 23. Through the operation of the ice-overflowing arm 28 and the controller, a predetermined amount of the pieces of ice is filled in the ice bank 30. The ice bank 30 keeps the pieces of ice to be consumed.

However, since the ice-making unit is installed in the freezing chamber of the conventional bottom freezer-type refrigerator. The conventional bottom freezer-type refrigerator has a drawback in that a capacity of the freezing chamber is reduced as much as a space occupied by the ice-making unit installed in the cold chamber.

SUMMARY OF THE INVENTION

Accordingly, the present invention is directed to a cold air guide structure of an ice-making chamber of a cold chamber door that substantially obviates one or more problems due to limitations and disadvantages of the related art.

An object of the present invention is to provide a guide unit for guiding cold air to allow the cold air to flow to the maximum in an insulated ice-making chamber, which is provided inside of a cold chamber door and in which an ice-making unit is installed.

Another object of the present invention is to provide an ice-making cold air inlet duct for guiding and sucking cold air into an ice-making chamber of a cold chamber door, as an ice-making cold air guide unit.

A further another object of the present invention is to provide a cold air guide duct for guiding and exhausting cold air from an ice-making chamber of a cold chamber door, as an ice-making cold air guide unit.

A still another object of the present invention is to provide a cold air inlet portion and outlet portion are disposed to different heights at different surfaces of an ice-making chamber.

A further still another object of the present invention is to provide a cold air guide plate for guiding and sucking cold air into an ice-making chamber of a cold chamber door up to a specific position of an ice-making unit, as an ice-making cold air guide unit.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided a cold air guide structure of an ice-making chamber of a cold chamber door, the structure including: the cold chamber door; an insulation case disposed inside of the cold chamber door, thermally insulated and having an ice-making chamber therein; an ice-making unit installed in the ice-making chamber of the insulation case, for icing a supplied water by an ice-making cold air and housing pieces of ice; an insulation cover for opening and closing the ice-making chamber of the insulation case; a cold air inlet port for sucking the ice-making cold air into the ice-making chamber; a cold air outlet port for exhausting the ice-making cold air from the ice-making chamber; a cold air supply duct disposed inside wall of the cold chamber, supplied to the cold air through the cold air outlet port; and an ice-making cold air guide unit for guiding the ice-making cold air to a predetermined air passage to suck or exhaust the ice-making cold air into or from the ice-making chamber.

The ice-making cold air guide unit has a cold air inlet passage and a cold air outlet passage provided at facing surfaces of the ice-making chamber, to guide to the predetermined air passage the ice-making cold air sucked into the ice-making chamber or the ice-making cold air exhausted from the ice-making chamber.

In another aspect of the present invention, there is provided a cold air guide structure of an ice-making chamber of a cold chamber door, the structure including: the cold chamber door having an insulated ice-making chamber at an inner side; an ice maker disposed in the ice-making chamber, for icing a supplied water by an ice-making cold air, and an ice bank disposed in the ice-making chamber, for keeping pieces of ice; a cold air passage hole for sucking and discharging the ice-making cold air to the ice-making chamber; and an ice-making cold air guide unit for guiding the ice-making cold air, which is sucked or discharged to the ice-making chamber, to the predetermined air passage.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
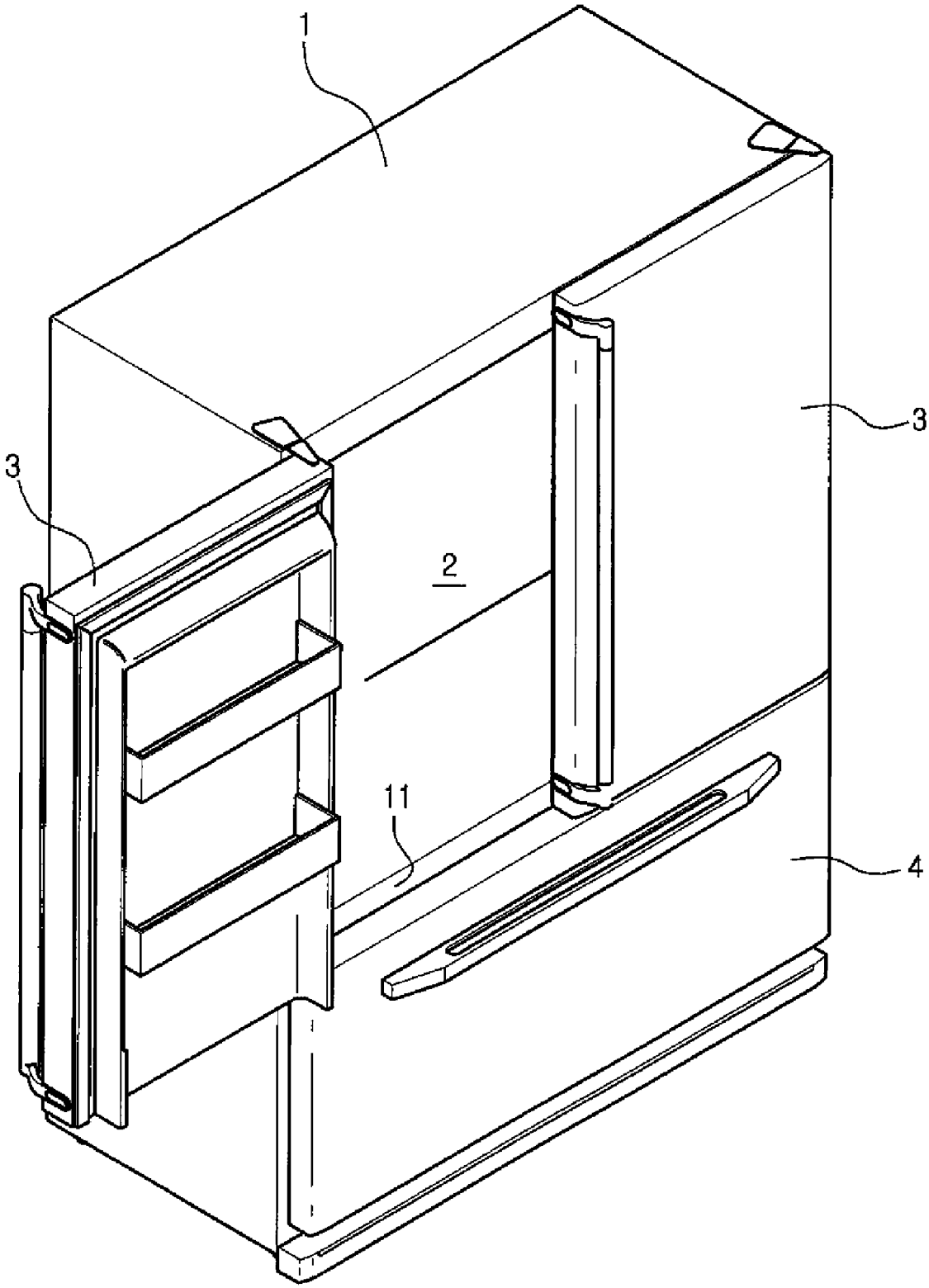
Fig. 1(Related Art)
FIG. 1 is a view illustrating a construction of a conventional bottom freezing chamber-type refrigerator.
Figure 2:
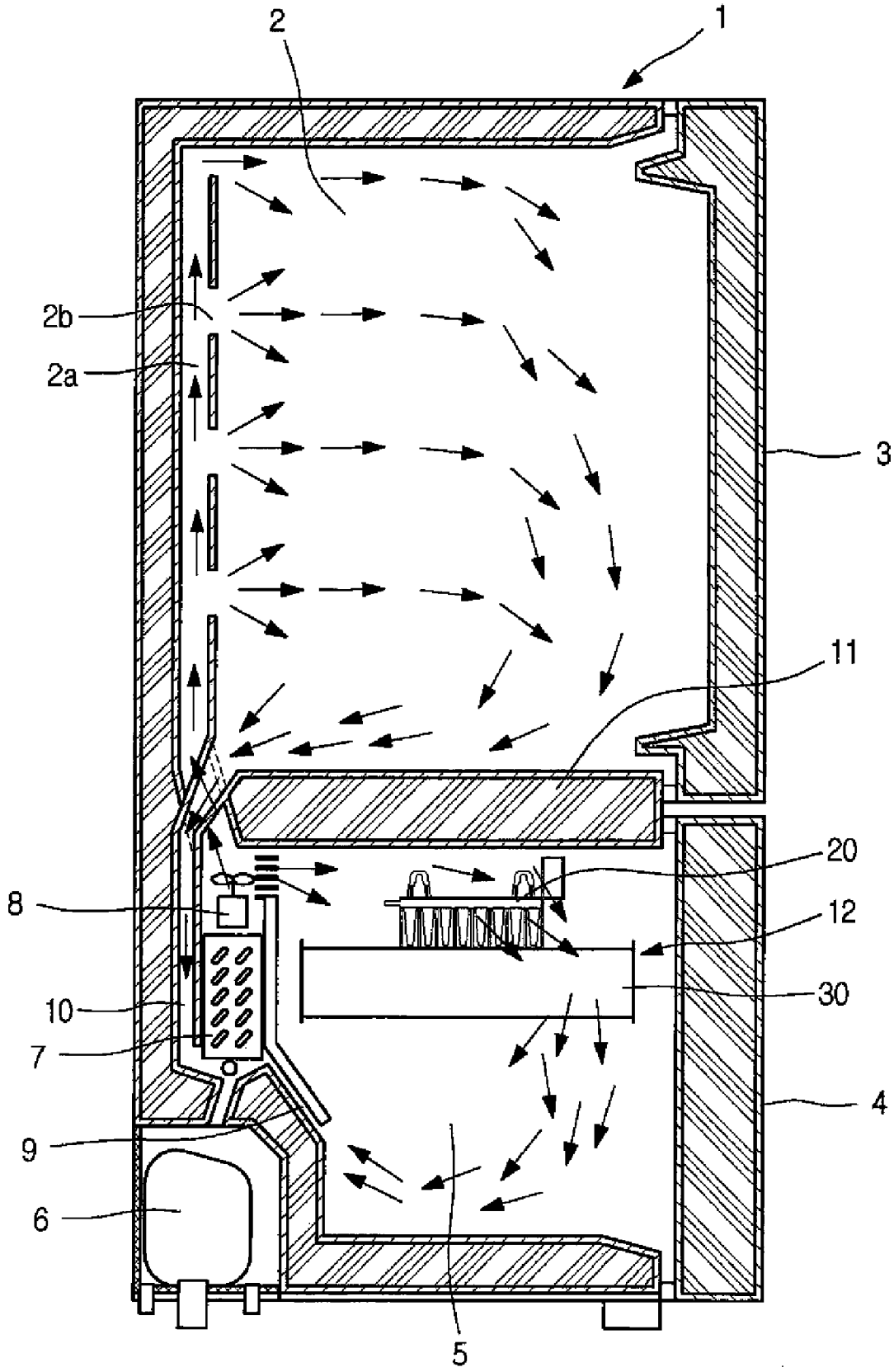
Fig. 2(Related Art)
FIG. 2 is a side sectional view illustrating a conventional bottom freezing chamber-type refrigerator having an ice-making unit installed in a freezing chamber.
Figure 3:
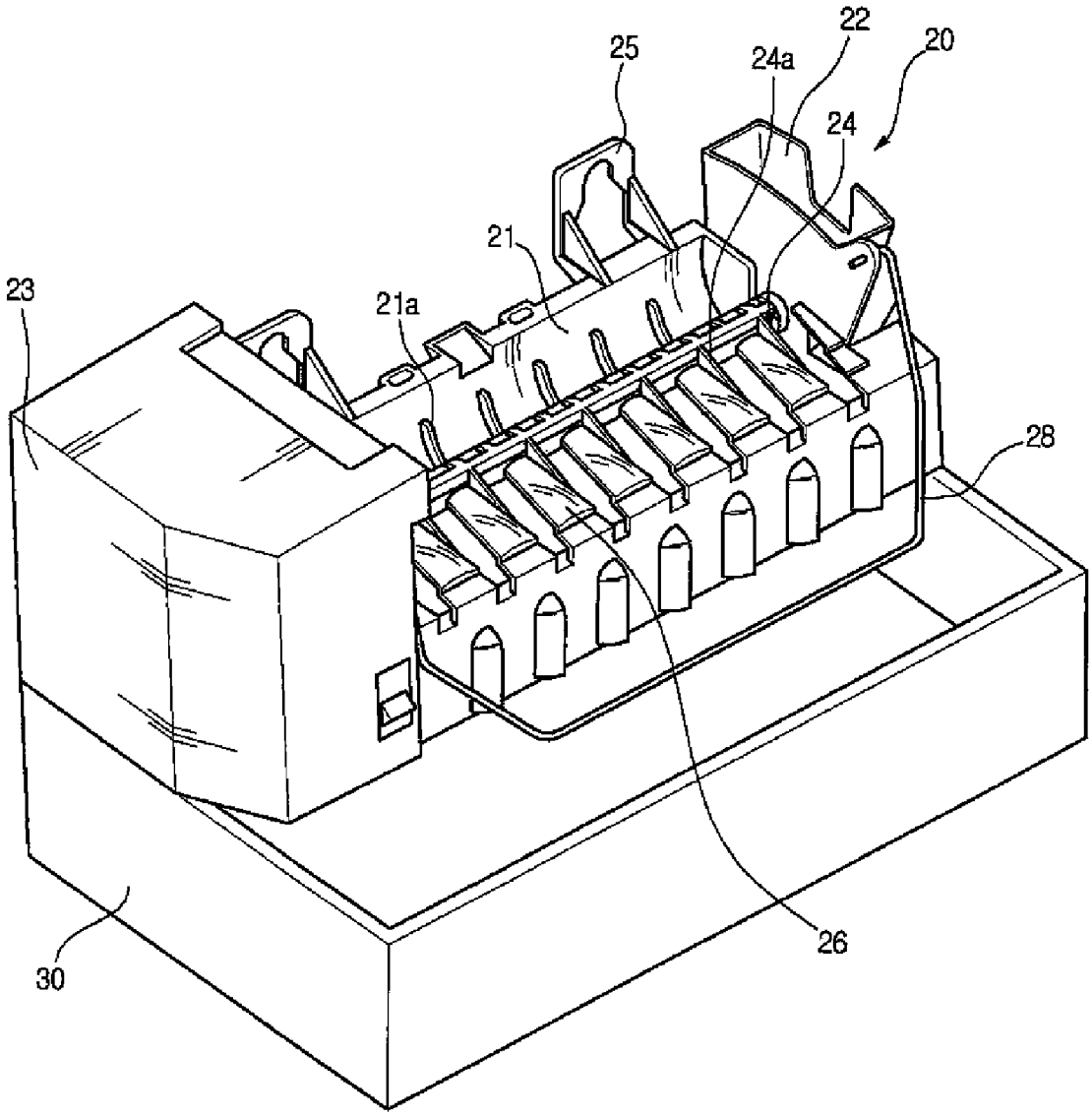
Fig. 3(Related Art)
FIG. 3 is a detailed view illustrating an ice-making unit of FIG. 2.
Figure 4:
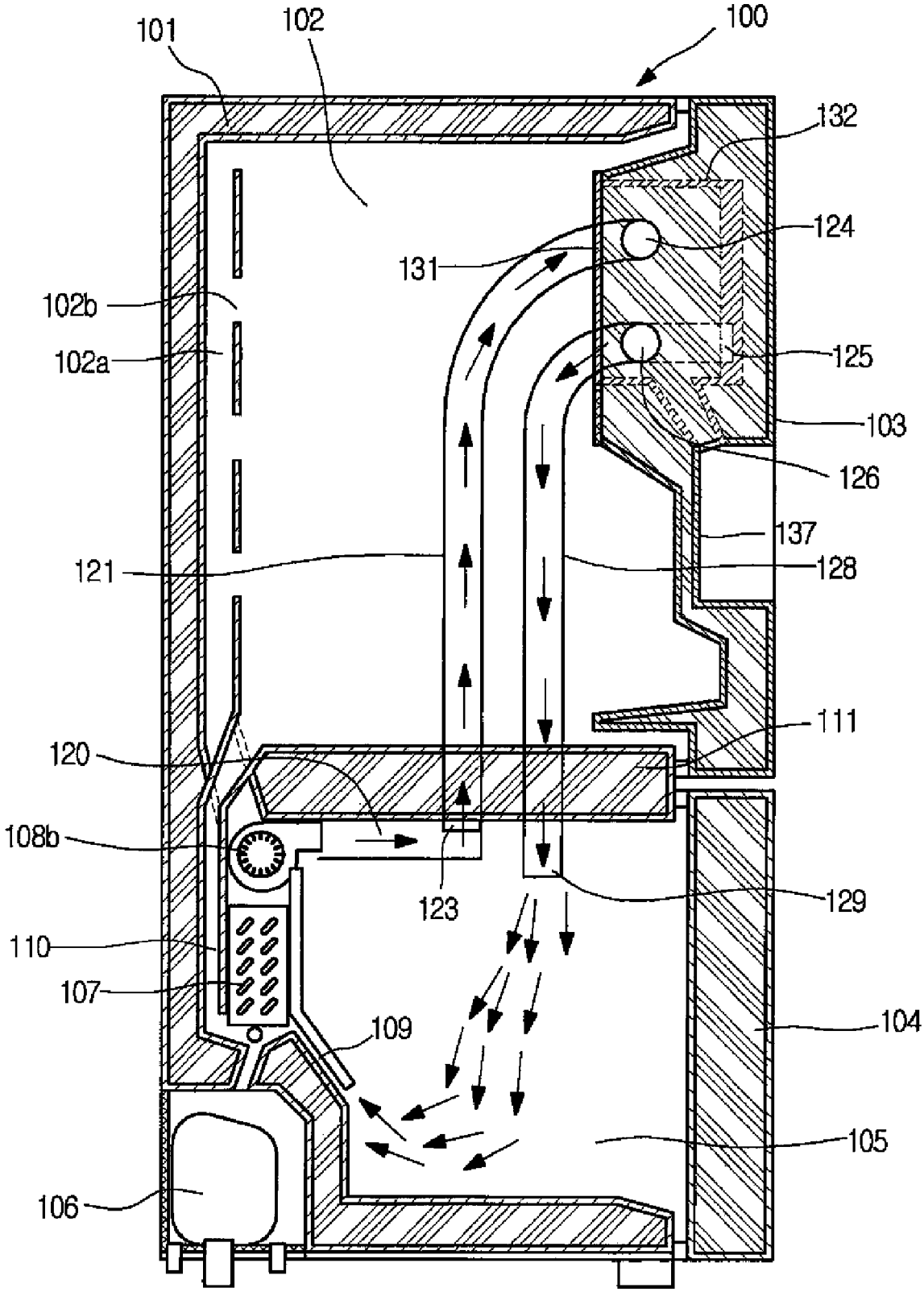
FIG. 4 is a side sectional view illustrating a bottom freezing chamber-type refrigerator having a cold air guide structure of an ice-making chamber of a cold chamber door according to one embodiment of the present invention.

FIG. 4 is a side sectional view illustrating a bottom freezing chamber-type refrigerator having a cold air guide structure of an ice-making chamber of a cold chamber door according to one embodiment of the present invention.

As shown in FIG. 4, the bottom freezing chamber-type refrigerator includes a cold chamber 102 and a freezing chamber 105 disposed up and down of a refrigerator body 101; a barrier 111 for partitioning an inner space of the refrigerator into the cold chamber 102 and the freezing chamber 105; doors 1 and 104 rotational connected to the refrigerator body 101 to open and close the cold chamber 102 and the freezing chamber 105; an evaporator 107 and a plurality of ventilation fans 108 and 108*b*; a cold air return ducts 109 and 110 for feeding back the cold air of the cold chamber 102 and the freezing chamber 105; cold air supply ducts 120 and 121 disposed at a sidewall of the body to allow the cold air of the freezing chamber to flow to the cold chamber door; a cold air return duct 128 disposed at a sidewall of the body to allow the cold air of the cold chamber door to flow to the freezing chamber; an insulation cover 131 and an insulation case 132 disposed inside of the cold chamber door; and an ice take-out port 136 and a dispenser 137 for dispensing pieces of ice from a lower part of the insulation case 132 to the exterior.

The insulation case 132 includes a cold air inlet port 124 connected with the cold air supply duct 121; an ice-making cold air guide duct 125 for guiding and exhausting the cold air of the ice-making chamber; and a cold air outlet port 126 connected with one end of the ice-making cold air guide duct 125 and connected with the cold air return duct 128. The cold air inlet port 124, the ice-making cold air guide duct 125, and the cold air outlet port 126 are disposed at one side of the insulation case 132.

Figure 5:
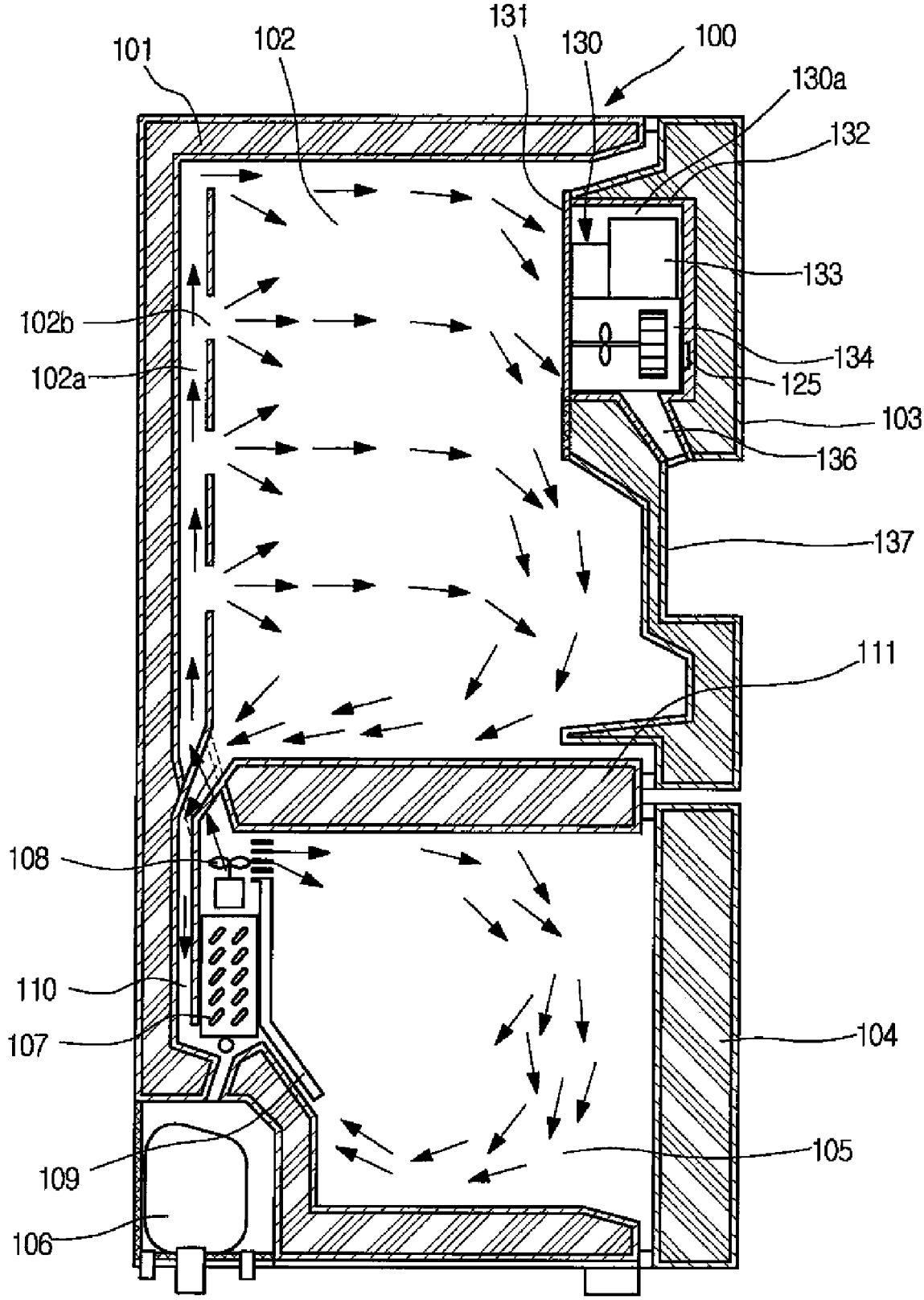
FIG. 5 is a side sectional view illustrating a cold air supply passage of a cold chamber and a freezing chamber of FIG. 4.

FIG. 5 is a side sectional view illustrating a cold air supply passage of a cold chamber and a freezing chamber of FIG. 4.

An ice-making unit 130 is installed in the ice-making chamber 130*a* of the cold chamber door 1. The ice-making unit 130 includes an ice maker 133 for icing a supplied water by using the cold air sucked into a cold air inlet port, and discharging the pieces of ice; and an ice bank 134 for keeping pieces of ice taken out by the ice maker 133. The ice take-out port 136 and the dispenser 137 are disposed down of the insulation case 132.

Hereinafter, the cold air guide structure of the ice-making unit of the cold chamber door in a bottom freezing chamber-type refrigerator according to the embodiment of the present invention is described.

First, with reference to FIGS. 4 and 5, in the bottom freezing chamber-type refrigerator 100, the cold chamber 102 and the freezing chamber 105 is partitioned up and down by the barrier 111, and the cold chamber 102 and the freezing chamber 105 are opened and closed by the doors 1 and 104 rotational installed at the refrigerator body 101.

The cold air supply ducts 120 and 121 and the cold air return duct 128 are provided at the sidewall of the refrigerator body 101 to be provided from a freezing chamber sidewall to a cold chamber sidewall. The cold air supply ducts 120 and 121 are comprised of a first cold air supply duct 120 and a second cold air supply duct 121, and are connected using a cold air hole 123 between the first cold air supply duct 120 and the second cold air supply duct 121. The first cold air supply duct 120 is provided to be in parallel with a freezing chamber ceiling or the freezing chamber sidewall, and the second cold air supply duct 121 is provided to the cold chamber sidewall as a predetermined air passage. Since the cold air return duct 128 is provided from the cold chamber sidewall to cold air hole 129 of the freezing chamber sidewall, the cold air can be returned to the freezing chamber.

Additionally, the insulation case 132 is installed inside of the cold chamber door 1, and the insulation cover 131 is provided to open and close the insulation case 131. Here, the insulation case 132 and the insulation cover 131 are formed of insulation material to cut off a thermal conduction with the exterior.

The cold air inlet port 124, the cold air outlet port 126 and the ice-making cold air guide duct 125 are provided at the insulation case 132. The cold air inlet port 124 and the cold air outlet port 126 are provided at inner up and down sidewalls of the insulation case 132 such that, when the cold chamber door 1 is closed, the cold air inlet port 124 and the cold air outlet port 126 are closely attached and coupled with the cold air supply duct 121 and the cold air return duct 128 provided at the sidewall of the refrigerator body 101.

In other words, if the cold chamber door 1 is closed, an inner sidewall of the insulation case 132 is closely attached with the cold chamber sidewall (or Mullion). At this time, the cold air inlet port 124 and the cold air outlet port 126 are respectively closely attached to the cold air supply duct 121 and the cold air return duct 128 provided up to the cold chamber sidewall, to provide a passage for allowing the freezing chamber cold air is supplied to the ice-making chamber of the cold chamber door and is again returned. Here, packings and the like can be also installed at a closely coupled portion to prevent the leakage of the cold air.

Meanwhile, the insulated ice-making chamber 130*a* is provided at the insulation case 132 disposed inside of the cold chamber door 1, and the ice-making unit 130 is installed at the ice-making chamber 130*a*. The ice take-out port 136 and the dispenser 138 are installed down of the insulation case 132 to exhaust the pieces of ice to the exterior.

As the ice-making unit 130 is installed at the ice-making chamber 130*a* of the cold chamber door, the freezing chamber cold air flows along the cold air supply ducts 120 and 121 and then, is supplied to the ice-making chamber 130*a* through the cold air inlet port 124. The cold air of the ice-making chamber 130*a* flows to the ice-making cold air guide duct 125 and then, is exhausted to the cold air outlet port 126 and again returned to the freezing chamber 105 through the cold air return duct 128.

Here, the refrigerator supplies the cold air to the freezing chamber, the cold chamber and the ice-making chamber. The passage for supplying the cold air to the ice-making chamber 130*a* is called a first cold air supply passage, and the passage for supplying the cold air to the freezing chamber and the cold chamber is called a second cold air supply passage.

In the first cold air supply passage, as shown in FIG. 4, the cold air discharged by the evaporator 107 and the second ventilation fan 108*b*, which is installed at an upper side of the evaporator 107, flows along the first cold air supply duct 120, the cold air hole 123 and the second cold air supply duct 121, which are provided at sidewalls of the barrier 111 and the body 101. After that, the cold air is supplied to the ice-making chamber 130*a* through the cold air inlet port 124 of the insulation case 132 installed at the cold chamber door 1.

Here, as the second ventilation fan 108*b*, a fixed-pressure fan is used to sufficiently supply the cold air to the ice-making chamber through the cold air supply ducts 120 and 121. Since the fixed-pressure fan discharges the cold air at a high pressure, a temperature difference between the discharged cold air and the freezing chamber can be reduced and an amount of wind can be increased.

Additionally, the cold air is bypassed from the ice-making chamber 130*a* disposed inside the insulation case 132 flows along the ice-making cold air guide duct 125 and then, is exhausted to the cold air outlet port 126. The exhausted cold air flows along the cold air return duct 128 provided at the sidewall of the body and then, is returned to the freezing chamber 105 through the cold air hole 129.

Additionally, in the second cold air supply passage, as shown in FIG. 5, the cold air discharged by the evaporator 107 and the first ventilation fan 108 is supplied to the cold chamber 102 through a cold air supply duct 102*a* and a cold air outlet port 102*b*, which are provided at the sidewall of the body, and is also discharged to the freezing chamber 105.

Further, the cold air supplied through the first and second cold air supply passages is circulated and introduced down of the evaporator along the cold air return ducts 109 and 110 provided at a rear wall of the freezing chamber.

An operation of supplying the cold air through the first and second cold air supply passages can be distinguished and performed, or can be commonly used. Here, the first cold air supply passage is used for the purpose of rapid ice manufacture. In case where it is not the case of the rapid ice manufacture, the first cold air supply passage can be used together with the second cold air supply passage. The two operation modes can be separately operated through a user's control of selection and ice-making time, or can be also commonly used. Additionally, in another embodiment, a single ventilation fan can be also installed instead of the first and second ventilation fans.

Figure 6:
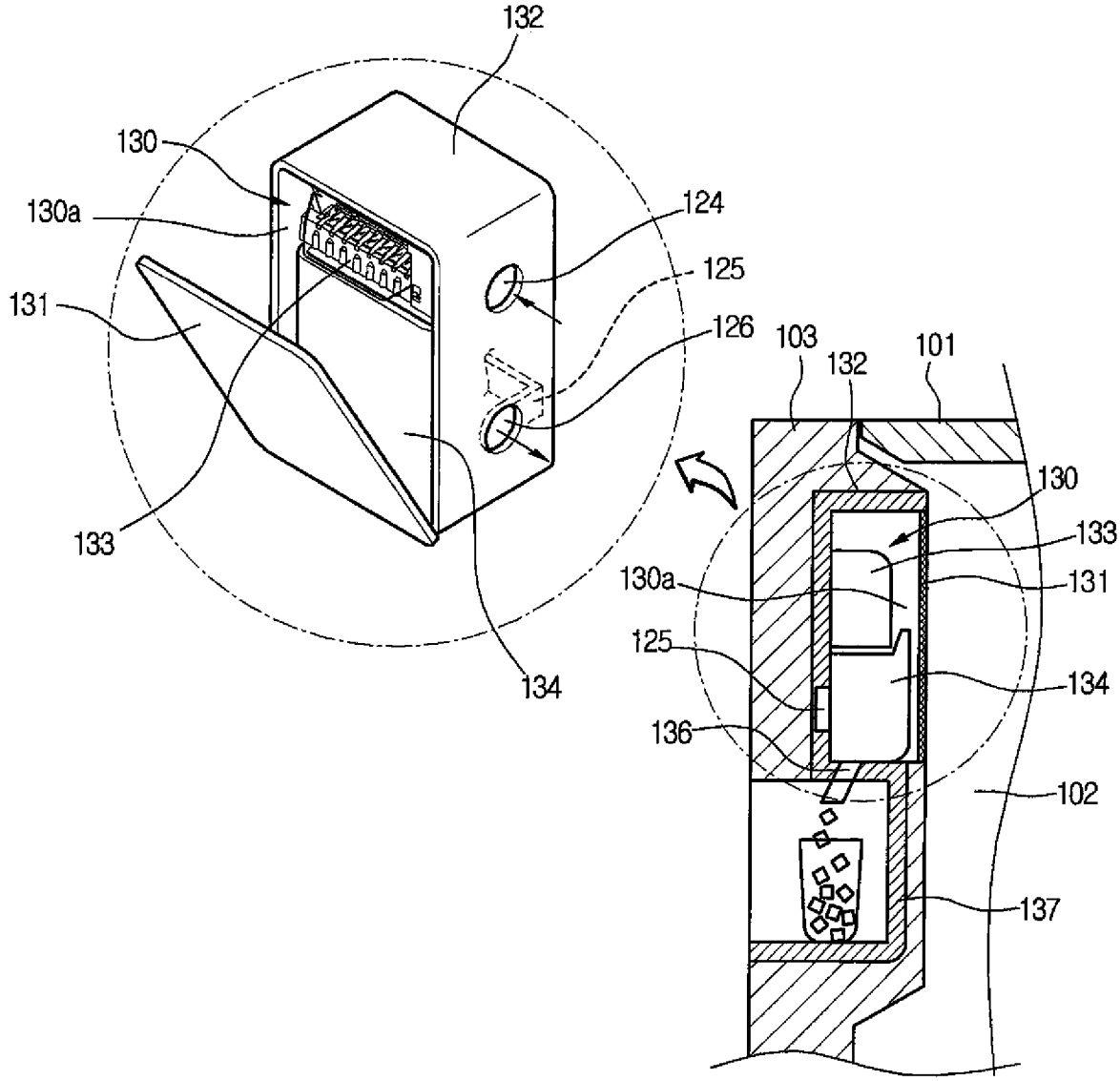
FIG. 6 is a view illustrating an ice-making unit installed in an ice-making chamber of a cold chamber door of FIG. 4.

Alternatively, as shown in FIG. 6, the ice-making unit 130 is installed in the ice-making chamber 130*a* formed by the insulation case 132 and the insulation cover 131. The ice-making unit 130 includes the ice maker 133 and the ice bank 134.

As the refrigerator is operated in a rapid ice-manufacture mode as shown in FIG. 4, the ice-making unit 130 can maintain the ice-making chamber below a predetermined temperature by the cold air (Hereinafter, referred to as "ice-making cold air") supplied to the ice-making chamber 130*a* of the insulation case 132. Accordingly, the ice maker 133 ices the supplied water by using the ice-making cold air supplied through the cold air hole 123, and takes out the pieces of ice toward the ice bank 134. The ice bank 134 keeps the taken-out pieces of ice. Additionally, the ice-making cold air is exhausted through the cold air outlet port 126.

At this time, the cold air supplied to the ice-making chamber 130*a* flows along the ice-making cold air guide duct 125 and then, is exhausted through the cold air outlet port 126.

The ice-making cold air guide duct 125 is provided on a circumference surface and along an inner wall of the insulation case 132 to have a "["-shape, as the ice-making cold air guide unit. According to another example of the present invention, the ice-making cold air guide duct communicating with the cold air inlet port 124 can be also provided at an upper side of the insulation case 132, and at least one duct can be provided at an inner wall of the insulation case to provide an inlet passage or an outlet passage for the ice-making cold air.

Figure 7:
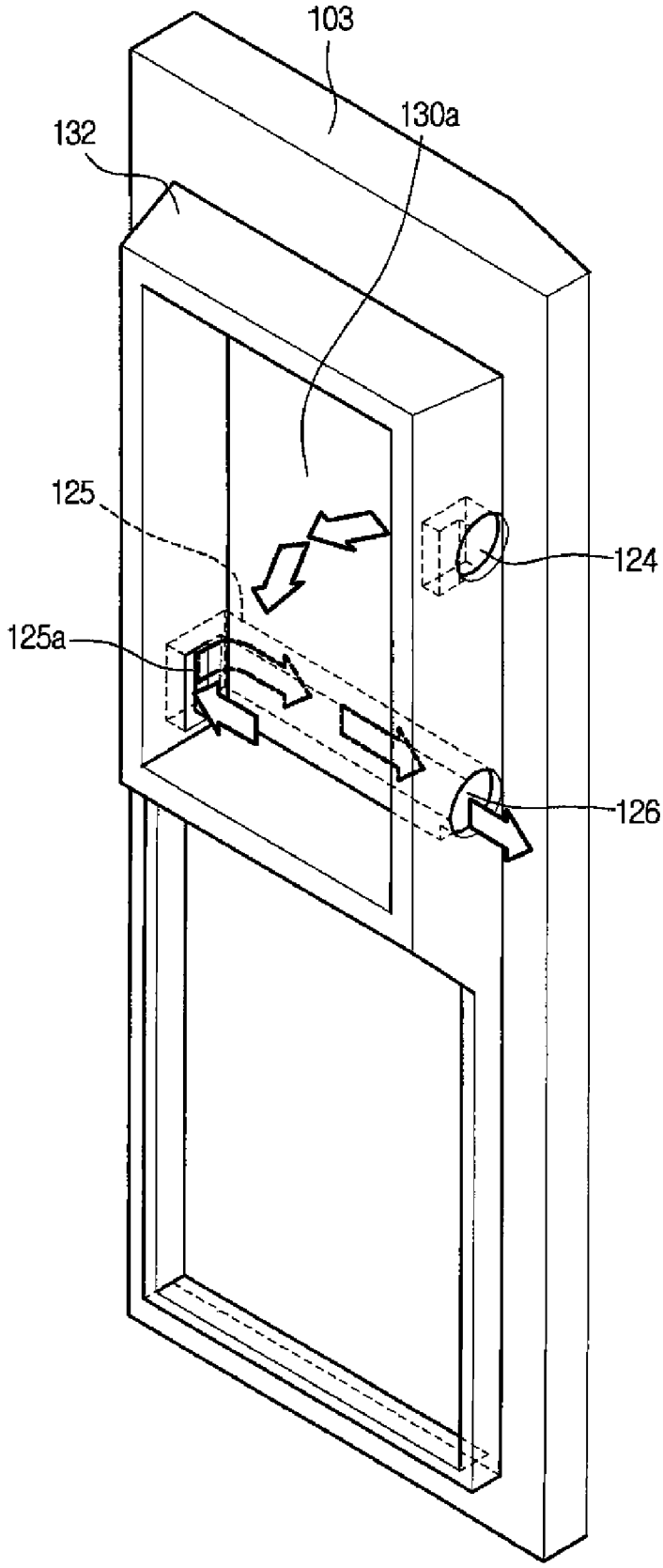
FIG. 7 is a perspective view illustrating an example of an ice-making cold air guide duct disposed inside an insulation case of FIG. 4.

Referring to FIG. 7, the ice-making cold air guide duct 125 is communicated at one end with a cold air exhaust port 125*a* provided at a left and lower side of the ice-making chamber of the insulation case 132, and is communicated at the other end with a cold air outlet port 126 provided at a right and lower side of the insulation case 132. Accordingly, the ice-making cold air sucked into the ice-making chamber 130*a* through the cold air inlet port 124 is exhausted through the cold air exhaust port 125*a*, the ice-making cold air outlet port 125, and the cold air outlet port 126.

Here, the cold air exhaust port 125*a* disposed at one side of the ice-making cold air guide duct 125 is installed to face with the cold air inlet port 124. Preferably, the cold air inlet port 124 and the cold air exhaust port 125*a* are installed in a diagonal direction to guide the ice-making cold air sucked into the ice-making chamber 130*a*, thereby passing through the ice-making unit 130 and the cold air exhaust port 125*a*. Here, at least one cold air exhaust port 125*a* is disposed to face with the cold air inlet port 124 or installed in an oblique direction.

Further, the cold air inlet port 124 and the cold air outlet port 126 are provided up and down of the same side surface and an outer side of the insulation case 132, and the cold air exhaust port 125*a* is installed in the ice-making chamber in a diagonal direction with respect to the cold air inlet port 124, to allow the cold air exhaust port 125*a* and the cold air outlet port 126 to communicate with each other at both sides of the ice-making cold air guide duct 125.

Figure 8:
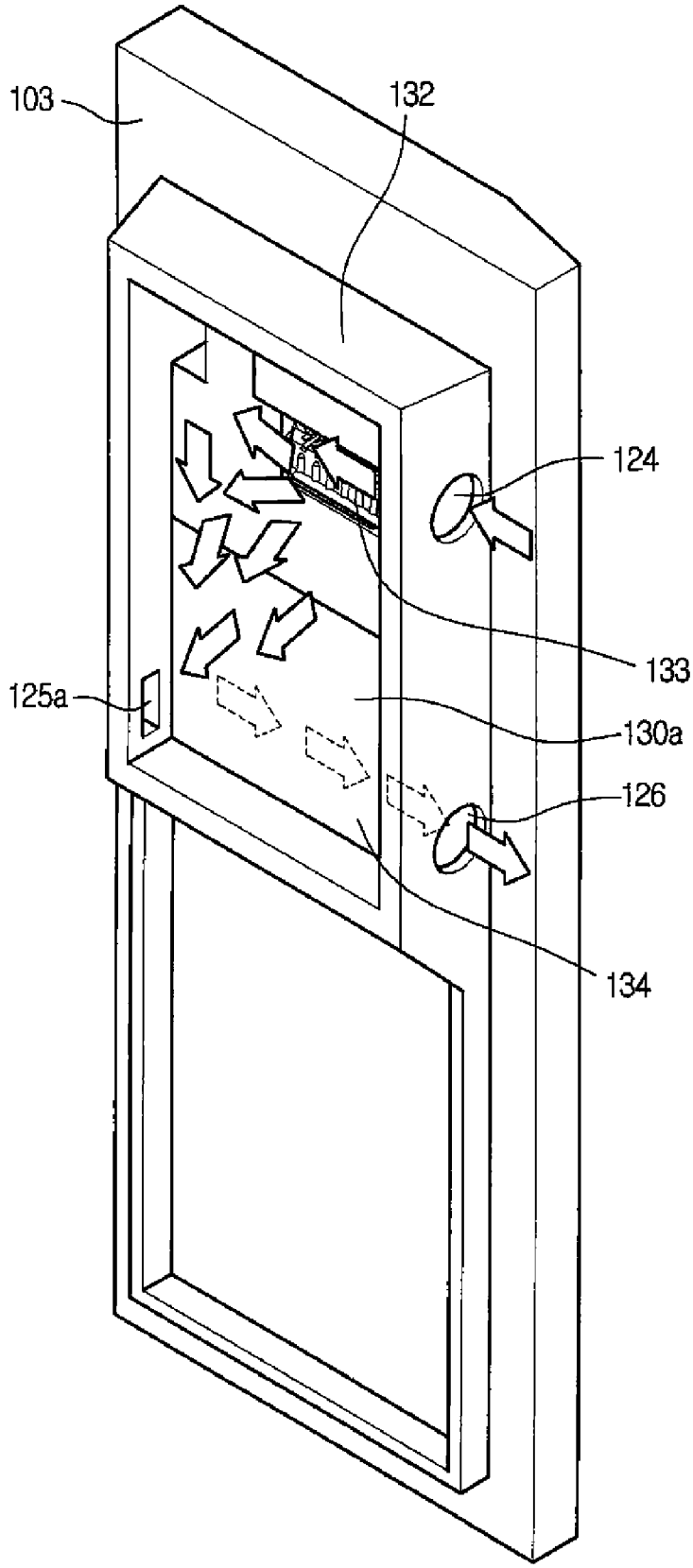
FIG. 8 is a view illustrating a flow state of cold air in an ice-making chamber of FIG. 7.

Referring to FIG. 8, as the cold air inlet port 124 and the cold air exhaust port 125*a* of the ice-making chamber 130*a* are disposed in the oblique direction, the ice-making cold air sufficiently flows between the ice maker 133 and the ice bank 134 and then, performs the ice manufacture.

Figure 9:
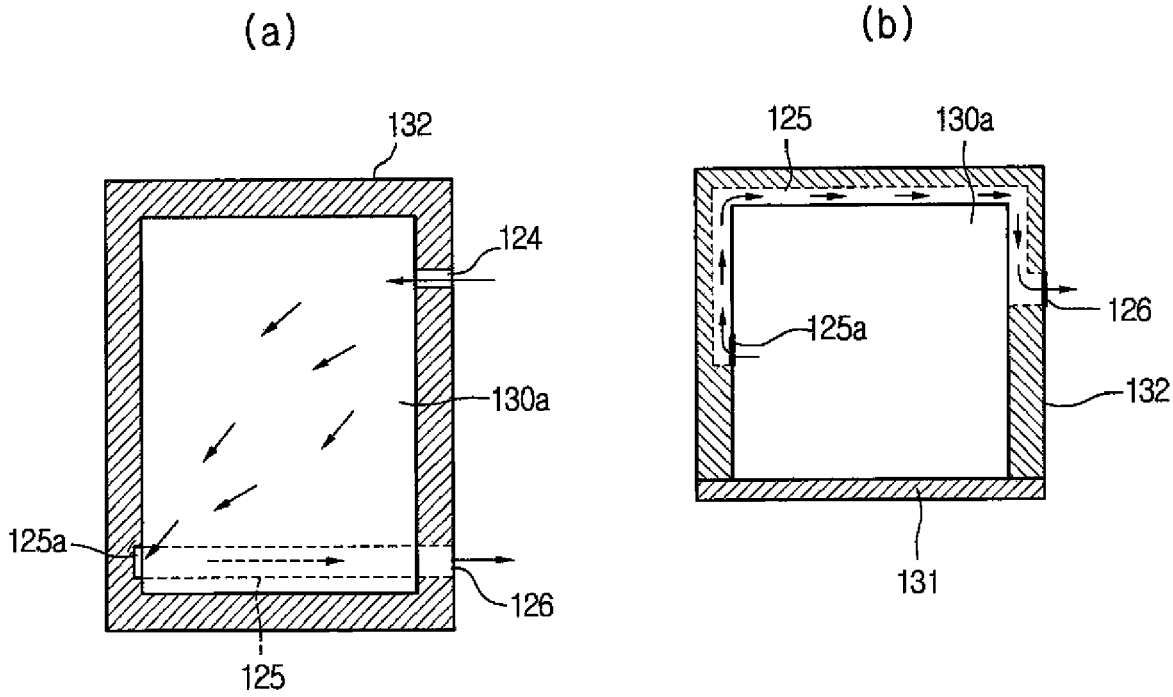
FIGS. 9A and 9B are a side sectional view and a sectional view of an insulation case illustrating a state in which cold air is exhausted through an ice-making cold air guide duct in an ice-making chamber of FIG. 7.

Detailed description is made with reference to FIGS. 9A and 9B. FIGS. 9A and 9B are a plan sectional view and a side sectional view of the insulation case. After the cold air sucked through the cold air inlet port 124, which is disposed at one and upper side of the ice-making chamber, flows to the cold air exhaust port 125*a*, which is disposed at the other and lower side of the ice-making chamber, the cold air flows along the ice-making cold air guide duct 125 and then is exhausted through the cold air outlet port 126 disposed at the one and lower side of the ice-making chamber.

As such, viewing from the ice-making chamber, the cold air inlet port for sucking the cold air and the cold air exhaust port for exhausting the cold air are installed at different surfaces. Further, the cold air inlet port and the cold air exhaust port can be disposed to have the different heights at the facing surface. Furthermore, the cold air inlet port and the cold air outlet port can be also exchanged in function at an outer side of the insulation case.

According to the present invention, it is desirable that the cold air exhaust port 125*a* provided at the other and inner surface of the insulation case is provided to form a triangle with the cold air inlet port 124 and the cold air outlet port 126. Further, the ice-making cold air guide duct 225 can be also installed at the insulation cover, not at the insulation case being an insulation member.

Figure 10:
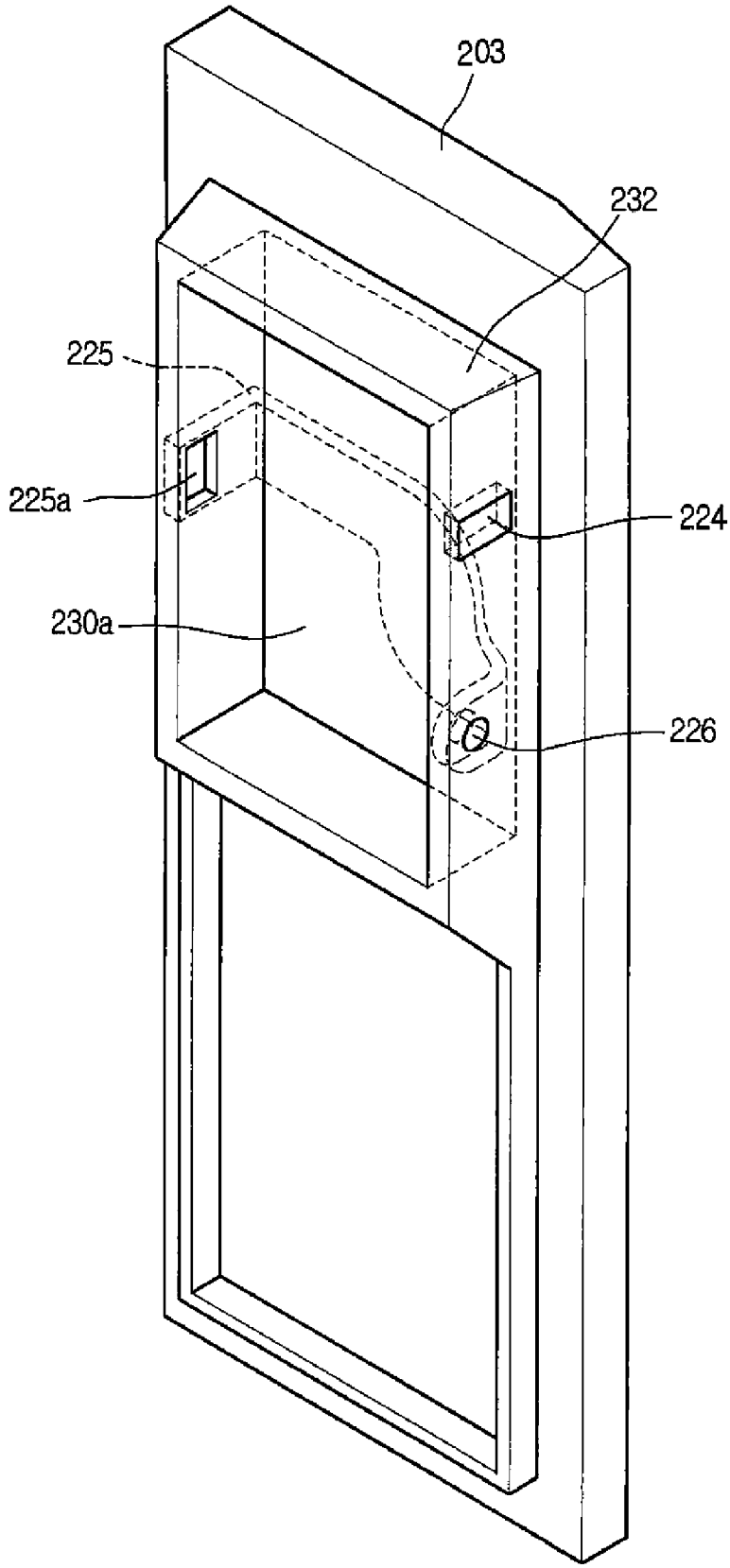
FIG. 10 is a perspective view illustrating an ice-making cold air guide duct of an insulation case according to another embodiment of the present invention.
Figure 11:
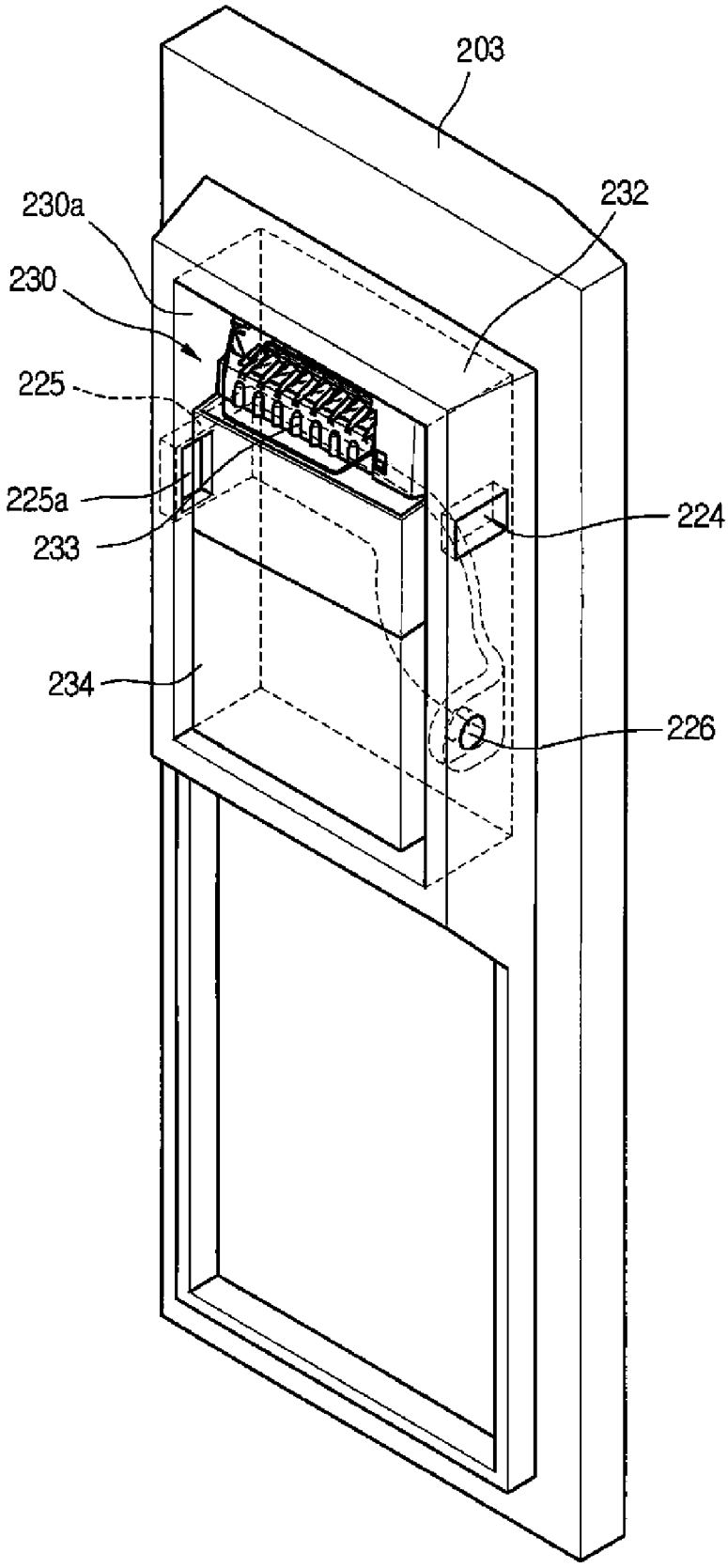
FIG. 11 is a view illustrating an installed state of an ice-making unit of FIG. 10.

FIGS. 10 and 11 illustrate an ice-making cold air guide duct according to another embodiment of the present invention. The ice-making cold air guide duct includes a cold air inlet port 224 provided at an upper and one side of an insulation case 232, which is provided at an inner side of a cold chamber door 2; a cold air outlet port 226 provided at a lower and one side of the insulation case 232; a cold air exhaust port 225*a* provided at a center of the other and inner surface of the insulation case 232; and an ice-making cold air guide duct 225 for communicating the cold air exhaust port 225*a* with the cold air outlet port 226 at both sides. Here, the ice-making cold air guide duct 225 is slantingly provided at an inner wall of the insulation case to have a predetermined width.

As shown in FIGS. 10 and 11, in order to maintain the ice-making cold air of the ice maker 233 and the ice bank 234, which are installed at the ice-making chamber 230*a*, below a predetermined temperature, the cold air is sucked into the cold air inlet port 224 provided at one and upper side of the insulation case 232, and is exhausted to the cold air exhaust port 225*a* provided at the other and inner surface of the insulation case 232.

The cold air exhausted to the cold air exhaust port 225*a* flows along the ice-making cold air guide duct 225 slantingly disposed, to be exhausted through the cold air outlet port 226 provided at one and upper side of the insulation case 232, thereby circulating the ice-making cold air. In this embodiment, even though the cold air exhaust port 225*a* is disposed at a center of the insulation case 232 comparing to the cold air inlet port 224, the ice-making cold air is sufficiently supplied up to the ice bank.

Figure 12:
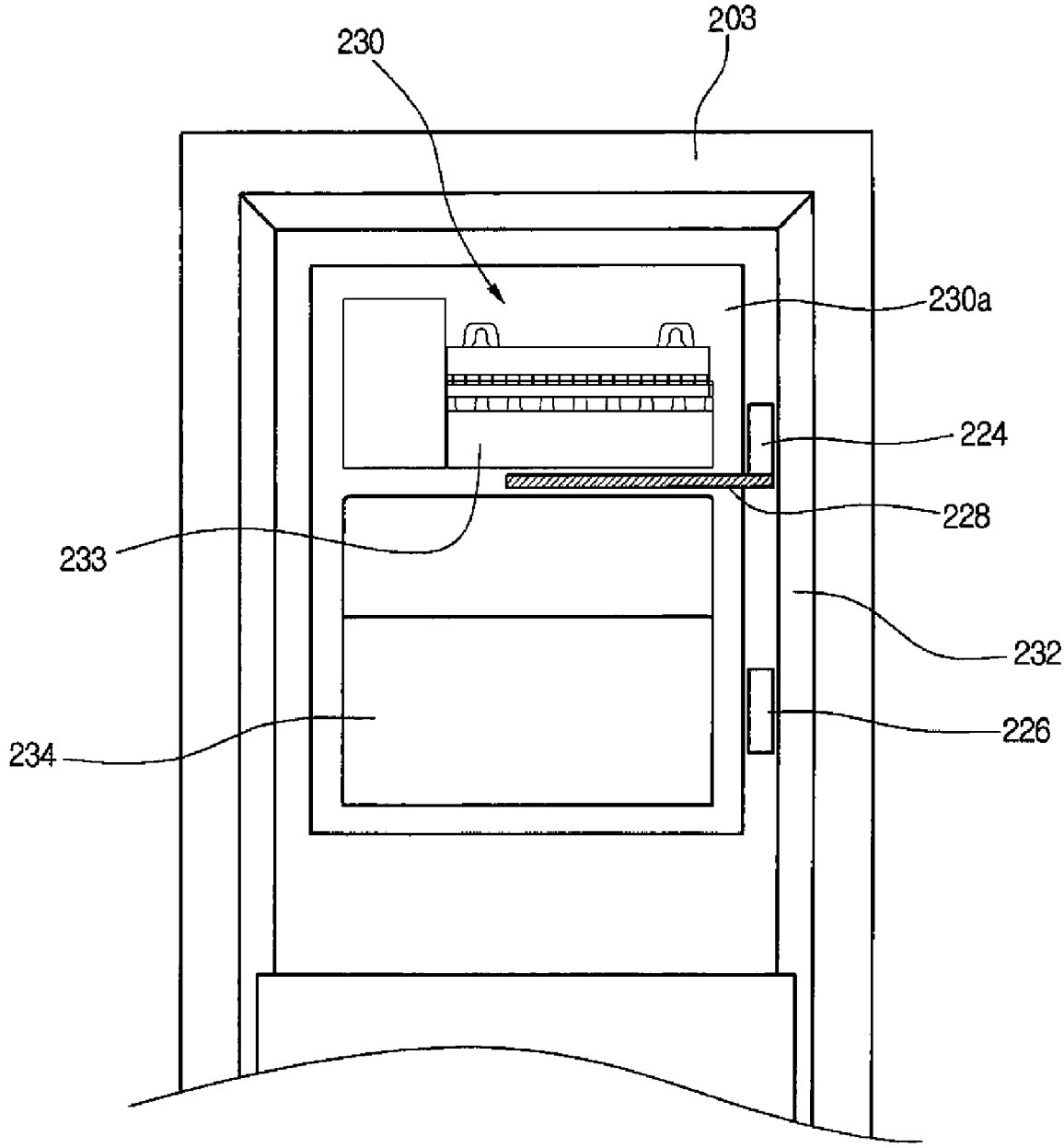
FIG. 12 is a front view of a cold chamber door illustrating another example of a cold air guide structure of an ice-making chamber of a cold air chamber door in a bottom freezing chamber-type refrigerator according to one embodiment of the present invention.
Figure 13:
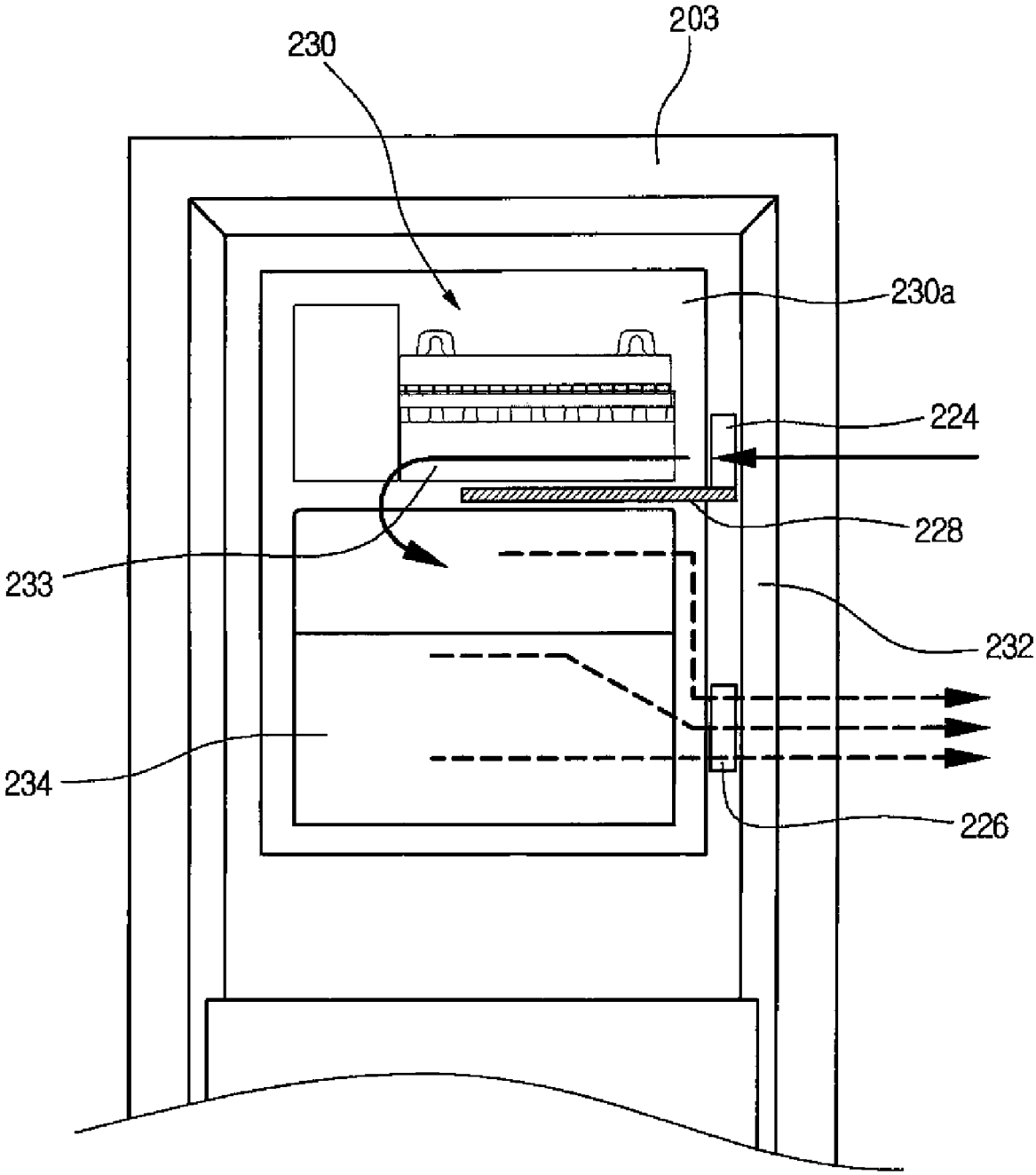
FIG. 13 is a view illustrating a flow state of cold air in an ice-making chamber of FIG. 12.

FIGS. 12 and 13 illustrate another embodiment of the present invention.

FIGS. 12 and 13 illustrate a cold air guide plate installed at a front of the cold air inlet port. An ice-making cold air guide plate 228 is provided as an ice-making guide unit between the ice maker 233 and the ice bank 234 disposed within the ice-making chamber 230*a*.

The ice-making cold air guide plate 228 is installed from a lower side of the cold air inlet port 224 up to a constant position of the ice maker 233 to have a plate shape, such that the ice-making cold air sucked into the ice-making chamber through the cold air inlet port 224 is forcibly flowed up to a predetermined position of the ice maker 233 along the ice-making guide plate 228.

Here, the ice-making guide plate 228 is extended from the cold air inlet port 224 up to a predetermined portion of a mold of the ice maker 223 and is provided to have a predetermined width. For example, it is formed to have a half to one third the length of the mold of the ice maker 223, and to have almost the same width as or a narrower width than the ice maker 233.

Referring in detail to FIGS. 12 and 13, the ice-making cold air sucked into the cold air inlet port 224 disposed at one side of the insulation case 232 can be flowed along a bottom surface of the mold of the ice maker 233 along the ice-making cold air guide plate 228 to drop a temperature of the mold of the ice maker 233 below a temperature of a different position of within the ice-making chamber, thereby improving a performance and an efficiency of ice manufacture.

Further, the ice-making cold air can be sufficiently flowed within the ice-making chamber by the ice-making cold air guide plate 228 without the installation of a separate duct, and the ice-making cold air can be discharged through the cold air discharge port 226 provided at one side of the insulation case.

Figure 14:
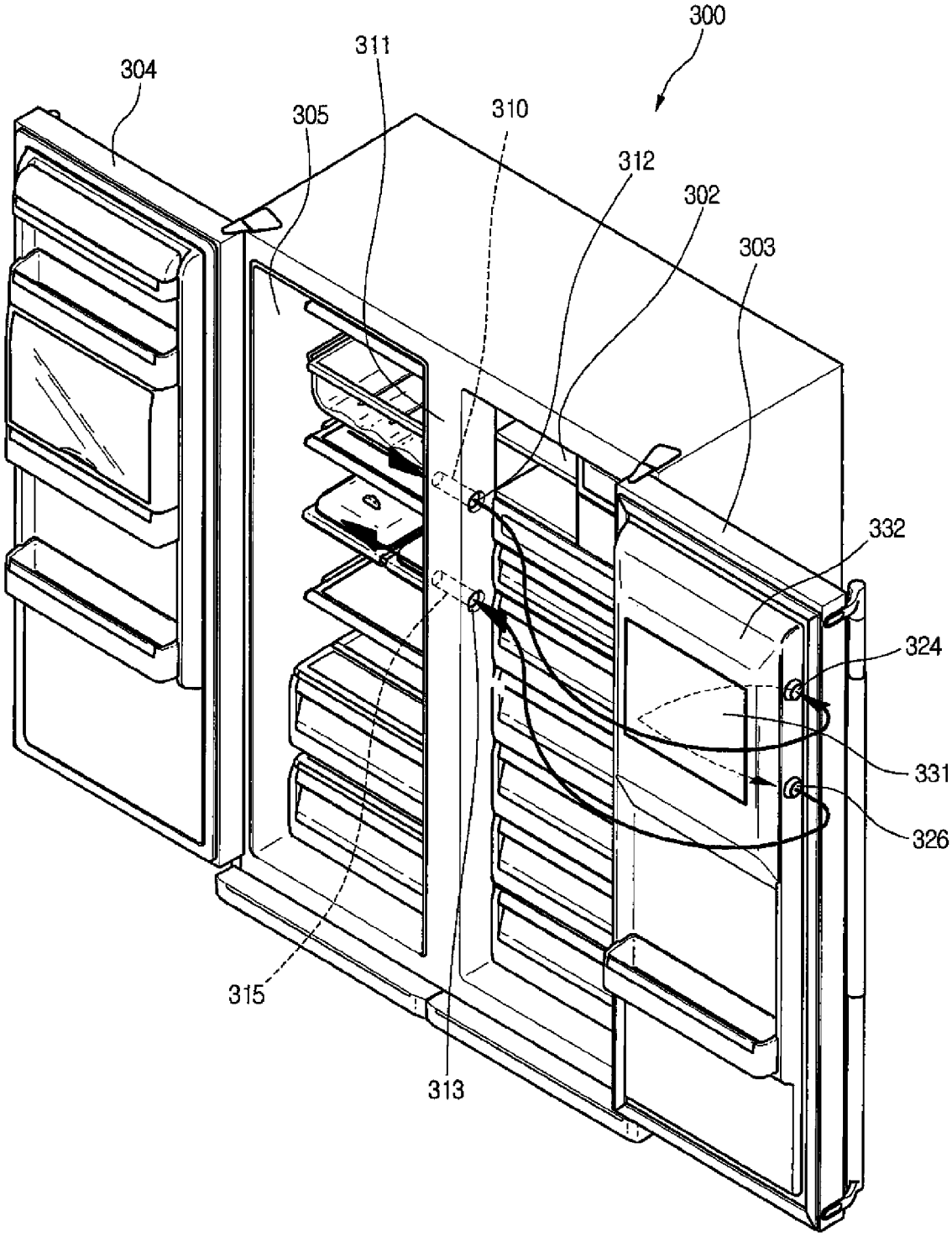
FIG. 14 is a view illustrating an example of a side by side-type refrigerator having a cold air passage of an ice-making chamber of a cold chamber door according to another embodiment of the present invention.

FIG. 14 illustrates a further another embodiment of the present invention.

As shown in FIG. 14, the present invention can be applied to the side by side-type refrigerator. As shown, the side by side-type refrigerator 300 is partitioned into a freezing chamber 305 and a cold chamber 302 at left and right sides by a barrier 311, and doors 303 and 304 are combined to open and close the freezing chamber 305 and the cold chamber 302. The ice-making unit is installed at a predetermined height of an inner side of the cold chamber door 303.

The ice-making unit includes an ice maker and an ice bank as essential structural elements, and is installed in an insulation space provided by an insulation case 332 and an insulation cover 331. In the ice-making unit, the ice-making cold air is sucked into the cold air inlet port 324 provided at one and upper side and at one and lower side of the insulation case 332 disposed at an inner side of the cold chamber door 303, and is exhausted through a cold air outlet port 326.

In other words, the freezing chamber cold air is sucked into the ice-making chamber through a cold air introduction port 310 of the barrier 311 and a cold air inlet port 324 of an insulation case 332, and the cold air used for ice manufacture by the ice-making unit is exhausted to the freezing chamber 305 through the cold air outlet port 326 of the insulation case 332 and a cold air exhaust port 315 of the barrier 311, thereby forming a circulation passage. The cold air introduction port 310 and the cold air inlet port 324, and the cold air outlet port 326 and the cold air exhaust port 315 are combined to have a concavo-convex shape such that the cold air is not leaked out to the exterior.

Figure 15:
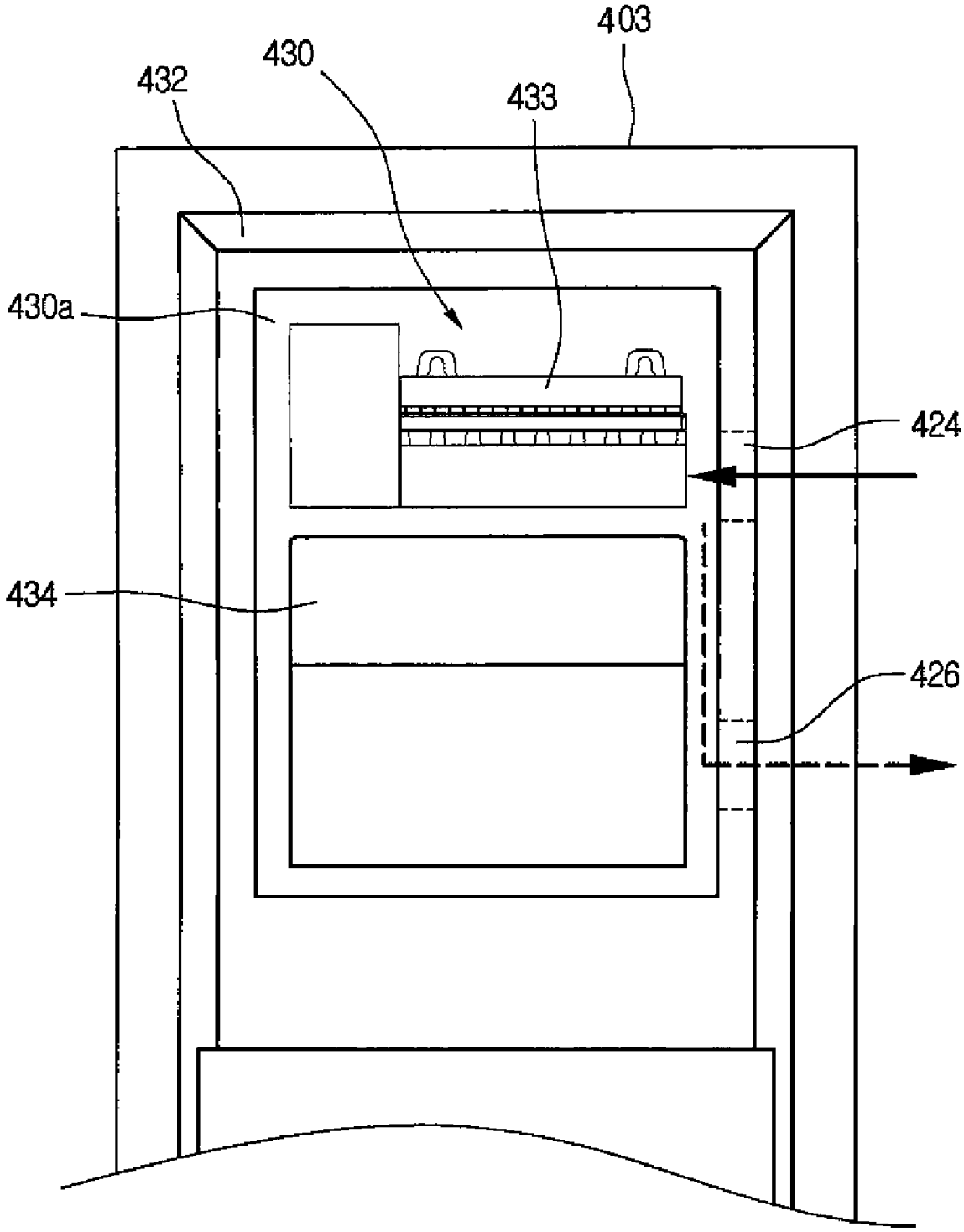
FIG. 15 is a view illustrating a conventional flow state of cold air in an ice-making chamber of a cold chamber door.

The ice-making cold air guide unit is provided in the insulation case or the ice-making chamber, which is disposed inside of the cold chamber according to the present invention, to guide the ice-making cold air to a specific position or a desired passage of within the ice-making chamber, thereby improving an efficiency of ice manufacture. However, as shown in FIG. 15, in case where a cold air inlet port 424 and a cold air outlet port 426 are provided at one side surface of an insulation case 432 installed inside of a cold chamber door 4 to suck and exhaust the cold air to the ice-making chamber 430*a*, the ice-making cold air is exhausted from the ice-making chamber 430*a* directly through the cold air outlet port 426 without great flow, thereby causing the efficiency of ice manufacture to be deteriorated due to the ice maker 433 and the ice bank 434.

The present invention provides the insulated ice-making chamber inside of the cold chamber door and provides the ice-making unit in the insulated ice-making chamber, and forms the ice-making cold air guide ducts as the predetermined air passage to maximize the cold air flow in the ice-making chamber. The present invention is not only applicable to the bottom freezer-type refrigerator, but also is applicable to the top mount-type refrigerator having the freezing chamber and the cold chamber and the side by side-type cold chamber door having the freezing chamber and the cold chamber partitioned left and right.

As described above, according to the cold air guide structure of the ice-making chamber of the cold chamber door, the ice-making cold air sucked into or exhausted from the ice-making chamber of the cold chamber door is guided to the predetermined bypass air passage to maximize the cold air flow in the ice-making chamber, thereby improving the efficiency of ice manufacture of the ice-making unit installed in the ice-making chamber.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A cold air guide structure of an ice-making chamber of a cold chamber door, the structure comprising:

the cold chamber door;

an insulation case disposed inside of the cold chamber door, thermally insulated and having an ice-making chamber therein;

an ice-making unit installed in the ice-making chamber of the insulation case, for icing a supplied water by an ice-making cold air and housing pieces of ice;

an insulation cover for opening and closing the ice-making chamber of the insulation case;

a cold air inlet port for sucking or discharging the ice-making cold air into the ice-making chamber;

a cold air outlet port for exhausting the ice-making cold air from the ice-making chamber;

a cold air supply duct disposed inside a wall of the cold chamber for supplying the cold air to the cold air outlet port;

an ice-making cold air guide unit for guiding the ice-making cold air to a predetermined air passage to suck or exhaust the ice-making cold air into or from the ice-making chamber; and an ice and water dispenser.

2. The structure according to claim 1, wherein the ice-making cold air guide unit is a bypass from the ice-making chamber to the cold air outlet port.

3. The structure according to claim 1, wherein the ice-making cold air guide unit has an ice-making cold air guide duct defined along an inner wall of the insulation case, for discharging the ice-making cold air.

4. The structure according to claim 3, wherein the ice-making cold air guide duct connects a cold air exhaust port and the cold air outlet port.

5. The structure according to claim 1, wherein the cold air inlet port and the cold air outlet port are defined in the same wall of the ice-making chamber and spaced a predetermined distance from each other.

6. The structure according to claim 1, wherein the cold air inlet port and the cold air outlet port are defined in different walls of the ice-making chamber.

7. The structure according to claim 1, wherein the cold air inlet port and the cold air outlet port are defined in a sidewall of the insulation case.

8. The structure according to claim 4, wherein the cold air exhaust port is provided in plurality.

9. The structure according to claim 4, wherein the cold air exhaust port is defined in a different wall of the ice-making chamber from a wall where the cold air inlet port is defined.

10. The structure according to claim 4, wherein the cold air exhaust port and the cold air outlet port are defined in opposite walls of the ice-making chamber.

11. The structure according to claim 4, wherein the cold air exhaust port and the cold air outlet port are defined in a diagonal location in the ice-making chamber.

12. The structure according to claim 1, wherein when the cold chamber door is closed, the cold air inlet port is connected to a cold air supply duct, which is disposed at a sidewall of a refrigerator body, to suck or discharge a freezing chamber cold air.

13. The structure according to claim 1, wherein when the cold chamber door is closed, the cold air outlet port is connected to cold air return duct, which is provided at the sidewall of the refrigerator body, to exhaust an ice-making chamber cold air.

14. The structure according to claim 1, wherein the ice-making unit has an ice maker for icing the supplied water by the ice-making cold air and taking out the pieces of ice, and an ice bank for keeping the pieces of ice taken out by the ice maker.

15. The structure according to claim 1, wherein the ice-making cold air guide unit has a bypass duct defined along an inner wall of the insulation case from the cold air inlet port to the ice-making chamber.

16. The structure according to claim 1, wherein the ice-making cold air guide unit has an ice-making air guide plate for the guiding.

17. A cold air guide structure of an ice-making chamber of a cold chamber door, the structure comprising: the cold chamber door;

an insulation case disposed inside of the cold chamber door, thermally insulated and having an ice-making chamber therein;

an ice-making unit having an ice maker and an ice bank that are installed in the ice-making chamber, the ice maker icing a supplied water by an ice-making cold air, the ice bank storing ice made by the ice maker;

an insulation cover for opening and closing the ice-making chamber of the insulation case;

a cold air inlet port for sucking or discharging the ice-making cold air into the ice-making chamber;

a cold air outlet port for exhausting the ice-making cold air from the ice-making chamber;

a cold air supply duct defined at a sidewall of a refrigerator body, for supplying an ice-making cold air from a freezing chamber to the cold air inlet port;

an ice-making cold air guide unit having a flat plate horizontally installed in the ice-making chamber, for guiding the ice-making cold air from the cold air inlet port to a predetermined location; and an ice and water dispenser.

18. The structure according to claim 17, wherein the ice-making cold air guide unit has a cold air guide plate extended from the cold air inlet port along a lower portion of the ice maker to have a predetermined length and a predetermined width.

19. The structure according to claim 18, wherein the cold air guide plate is extended up to an end of a mold of the ice maker.

20. The structure according to claim 17, wherein an ice-making cold air guide unit is extended up between the cold air exhaust port and the cold air inlet port defined along an side wall of the insulation case.

* * * * *